US007047990B2

(12) United States Patent
Zambrano et al.

(10) Patent No.: US 7,047,990 B2
(45) Date of Patent: May 23, 2006

(54) ARTICULATED CANE

(75) Inventors: Thomas Zambrano, Long Beach, CA (US); Taras Kiceniuk, Jr., Santa Paula, CA (US); Ronald Vandenbrink, Pasadena, CA (US)

(73) Assignees: Aerovironment, Inc., Monrovia, CA (US); City of Hope, Duarte, CA (US)

( * ) Notice: Subject to any disclaimer, the term of this patent is extended or adjusted under 35 U.S.C. 154(b) by 159 days.

(21) Appl. No.: 10/413,762

(22) Filed: Apr. 15, 2003

(65) Prior Publication Data

US 2004/0206384 A1 Oct. 21, 2004

(51) Int. Cl.
*A61H 3/02* (2006.01)
*A45B 9/04* (2006.01)

(52) U.S. Cl. ..... 135/82; 135/83; 135/84; 403/122

(58) Field of Classification Search ..... 135/82–84, 135/77; 403/122, 90, 135–138
See application file for complete search history.

(56) References Cited

U.S. PATENT DOCUMENTS

| | | | | | |
|---|---|---|---|---|---|
| 332,684 | A | * | 12/1885 | Tuttle | 135/69 |
| 710,074 | A | * | 9/1902 | Pratt | 135/84 |
| 2,230,406 | A | * | 2/1941 | Johnson | 135/77 |
| 2,642,074 | A | | 6/1953 | Pedley et al. | |
| 3,289,685 | A | * | 12/1966 | McCall Parker et al. | 135/65 |
| 3,731,698 | A | | 5/1973 | Buchalter | |
| 4,440,186 | A | | 4/1984 | Lottner | |
| 4,493,334 | A | | 1/1985 | Semanchik et al. | |
| 4,510,957 | A | * | 4/1985 | Frank | 135/84 |
| 4,708,154 | A | | 11/1987 | Edwards | |
| 4,940,203 | A | | 7/1990 | Hayakawa | |
| 4,947,882 | A | * | 8/1990 | Levasseur | 135/84 |
| 5,088,513 | A | * | 2/1992 | Ostermeyer | 135/82 |
| 5,782,256 | A | | 7/1998 | Bradley | |
| 6,138,699 | A | * | 10/2000 | Su | 135/82 |
| 6,164,305 | A | * | 12/2000 | Herman | 135/68 |
| 2004/0250845 | A1 | * | 12/2004 | Rudin et al. | 135/77 |

FOREIGN PATENT DOCUMENTS

| | | | |
|---|---|---|---|
| DE | 41 08 834 | A1 * | 9/1992 |
| EP | 0 071 982 | A2 * | 2/1983 |
| FR | 2 637 178 | * | 4/1990 |

* cited by examiner

*Primary Examiner*—Robert Canfield
(74) *Attorney, Agent, or Firm*—Perkins Coie LLP

(57) ABSTRACT

An improved cane to assist walking, comprising a shaft, a base and an articulated connection allowing the base to pivot relative to the shaft, depending upon the slope of the surface below the base, the connection characterized in that articulation capability decreases as downward loading on the shaft is increased, and articulation capability increases as downward loading on the shaft is decreased. Articulation capacity may have a path of resistance that guides the user into selected patterns of therapeutic motion.

26 Claims, 12 Drawing Sheets

10
10a
20
10b
21
17b
23
17b
16
17a
15
17

10
10a
13
12
10b
21
24
22
23
15c
17c'
17c
17b'
17a 27
26
25
24
22
23
17b
17b'
17a
16b
SLOPE

ARTICULATED CANE

BACKGROUND OF THE INVENTION

This invention relates generally to guided therapeutic movement (GTM). More specifically, the invention further relates to cane articulation to enhance or enable stable usage on sloping or uneven ground or floor surfaces. The invention also concerns articulation capability which varies as a function of downward force exertion on the cane shaft, to enhance stability of usage, and promote a normal stride.

In the past, canes have been provided with four legs on a base. Such "quad" canes can provide a stable reference point, which helps with the operator's balance, however when used on sloping ground the top of a quad cane can be in an awkward position and the angle of the cane can be poor for proper support. Standard quad canes generally prove unstable when all four legs are not in contact with the ground surface, which often occurs on uneven ground. Quad canes do not comfortably allow a normal stride.

Accordingly, there is a need for a cane providing better stability and providing support assurance to the user walking on uneven ground surfaces.

SUMMARY OF THE INVENTION

The invention relates to a new class of equipment to meet the needs of patients and therapists by both providing secure support and encouraging proper therapeutic movement. The user's movement is guided by the structural and mechanical design of the equipment, which encourages healthy natural movement while providing stability and security.

Walking is an important area where therapeutic motion can be very beneficial. The therapeutic equipment needed can be quite simple. By providing a cane or walking stick with the proper articulation, the user can be guided into a therapeutic pattern or gait. Security and support are crucial needs. By a controlled locking of the articulation, both free motion and firm support can be provided as needed.

Currently available equipment such as quad canes and walkers generally provide only support. Unfortunately, these types of equipment will often result in an awkward gait and prove a hindrance to relearning proper natural movement. In contrast, controlled cane articulation is a good way to provide a person with security and support and also encourage therapeutic motion.

In a first aspect of the invention, a cane with articulation allows for a normal stride, promoting good posture as well as assured balance on level ground and uneven surfaces. In a second aspect, the present cane acts as an assistive device for guiding the user into therapeutic and recuperative motion in addition to providing stability and support. Guided Therapeutic Motion (GTM) is promoted through the use of pivot parameters and articulation combinations. As a result, the present cane becomes an effective therapeutic tool in addition to a support device. As used here, the words articulation or articulated refer to a connection or joint between two (or more) elements. The words controlled or variable resistance refer to selecting, adjusting or varying the characteristics of relative movement between two (or more) elements, to, for example, provide more or less resistance to bending, pivoting or torsional movement between the elements.

In a third aspect, equipment is provided for guiding the body in proscribed motion as, for example, by providing guided motion in a compact piece of equipment that can also serve as a mobile support (i.e. cane, crutch, walker or support stand). The guided motion apparatus is well suited to use in articulated canes, with user controlled resistance to articulation. Such cane embodiments provide stability on sloping ground.

In a preferred design, the shaft of a cane is connected to a base through an articulated connection. The connection preferably has a pivot providing variable resistance. The pivot is operatively connected to one of the shaft and base, and a gripper is connected to the other of the shaft and base. Resistance to pivoting movement increases in response to increasing downward loading on the shaft. The pivot may comprise a ball which may have a spherical or oval shaped surface.

The gripper, or plurality of grippers, typically engage the ball as downward pressure is exerted on the handle. The grippers can be forced together by a sliding collar with taper and low sliding friction. Low friction can be achieved by use of rollers held in a carrier. A four-jaw gripper arrangement may be provided with collar and rollers. As the taper angle is reduced, the gripping leverage of the assembly is increased, but the stroke of the gripping is reduced. Because of the high leverage needed and resulting short stroke, the gripper assembly may require rigid construction, so that the gripping stroke is not all consumed "taking up the slack" in the system.

In an alternative embodiment, the gripping action can be achieved by deformation of the ball rather than motion of gripping jaws. To reduce ease of articulation the ball may be expanded by means of internal fluid pressure. The fluid pressure can be produced by a piston and cylinder arrangement actuated by relative force between the shaft and the ball supporting tube assembly. In this expanding ball system, the ball can articulate with the shaft and handle assembly rather than with the lower assembly as in the moving gripper jaw arrangement. To achieve a firm reduction in articulation, the expanding ball can have internal dividers or septums. These dividers can act as a shear web that restricts any significant rotation of the ball relative to the ball supporting assembly and the shaft. The number of forms of the septums, as well as other ball parameters, can be used to guide articulation.

In one preferred embodiment, a gripper assembly includes first and second parts, the first parts engaging the ball at laterally opposite sides thereof, and the second parts located to exert lateral force on the first parts tending to displace them laterally toward one another in response to increasing downward loading on the second parts. The gripper may define a socket in which the ball is received, and typically, the socket may be formed by the above referenced first parts. The gripper assembly may advantageously include friction surface inserts that engage the surface of the ball.

Tension members interconnecting the first and second parts transmit increasing lateral force components to the first parts as the second parts are displaced downwardly relative to the first parts. This reduces shaft articulation. Such tension members may extend in generally lateral directions to become "cocked" or skewed when downward force is exerted on the cane shaft. The tension members may advantageously be located or extend generally below the level of a center point defined by the pivot or ball.

Ball and socket interfaces, at least one of which is textured to provide enhanced frictional gripping, may be used.

The base may be in the form of a platform having at least two downward protrusions such as legs to engage said surface. Three such protrusions are preferably employed. Such protrusions are preferably outside a zone within which downward projections from the parts extend.

These and other objects and advantages of the invention, as well as the details of an illustrative embodiment, will be more fully understood from the following specification and drawings.

DETAILED DESCRIPTION

In FIGS. 1–11, a preferred cane assembly includes an upright shaft 10 having upper and lower tubular portions 10*a* and 10*b*. Handle 11 is mounted on upper portion 10*a*. The portions 10*a* and 10*b* may have telescopic interfit, as shown, allowing the upper portions to be extended or lengthened (or shortened) relative to the lower portions. A spring urged detent 12 carried by lower portion 10*b* is selectively received through holes 13 spaced along the wall of the shaft upper portion to hold the portions 10*a* and 10*b* in selected cane length position, adjusting to the height of the user.

Figures 1, 2, 3:
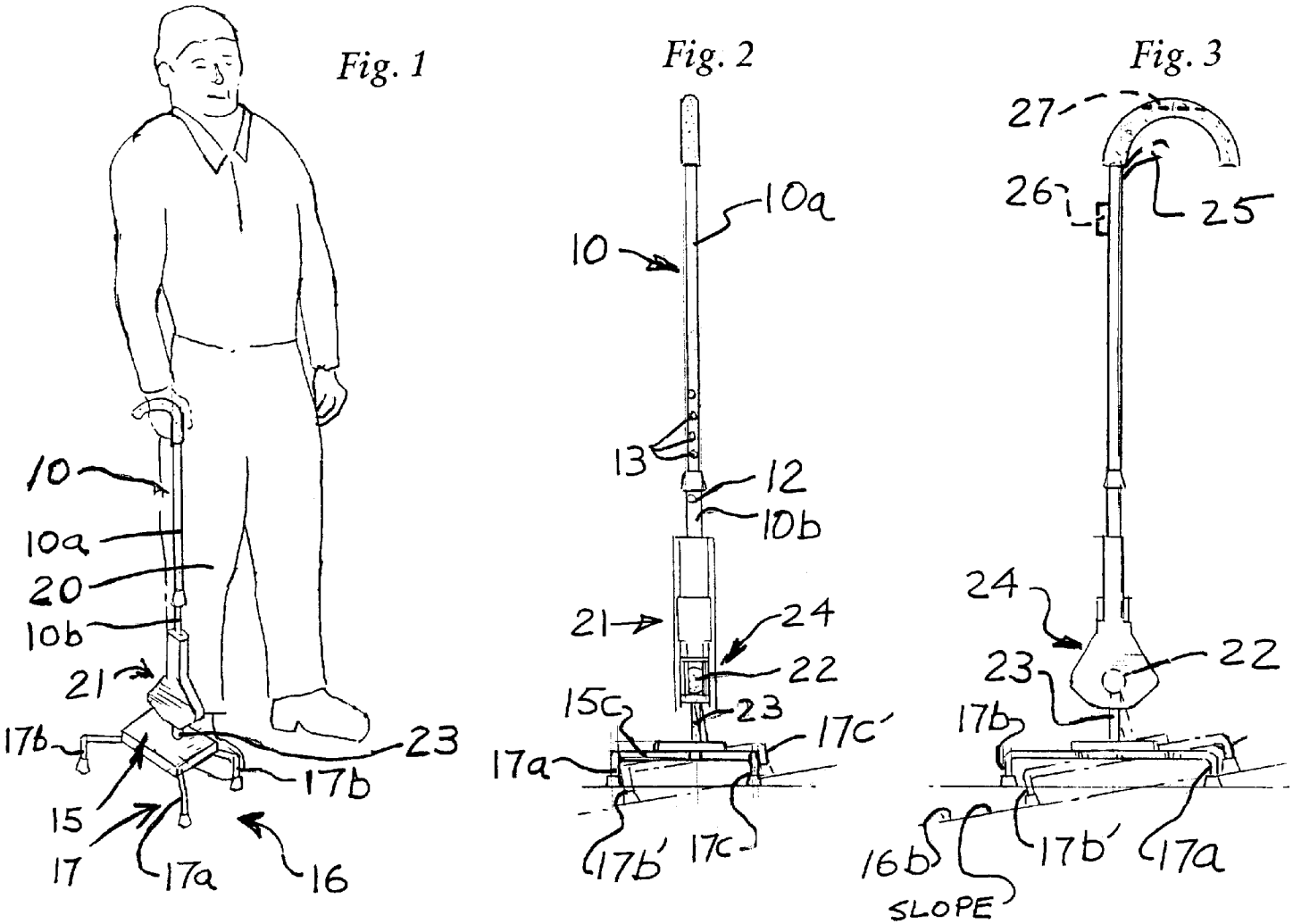
FIG. 1 is a perspective view showing use of a cane incorporating the invention.
FIG. 2 is a frontal elevation view of the cane seen in FIG. 1.
FIG. 3 is a side elevational view of the cane seen in FIG. 1.

A base 15 is provided to engage the ground or floor surfaces 16, which may be uneven, sloped or slanted, as seen at 16*a* in FIG. 2, and 16*b* in FIG. 3. The base may advantageously include a plate or support 15*c*, and legs 17 carried by that support, to project downwardly as shown.

Figure 1B:
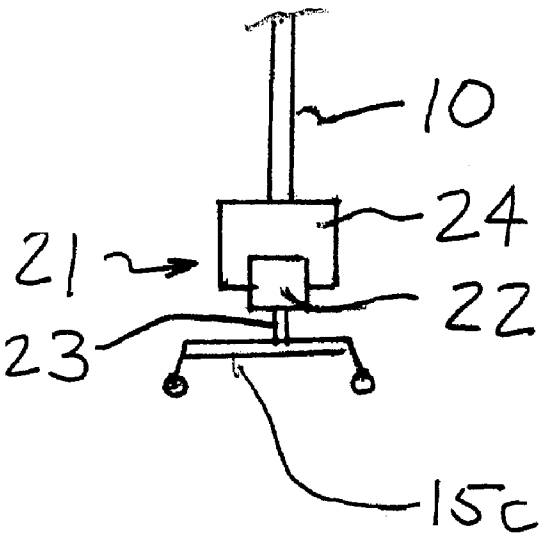
FIG. 1*b* is a schematic elevation view of assembly elements.
Figure 1A:
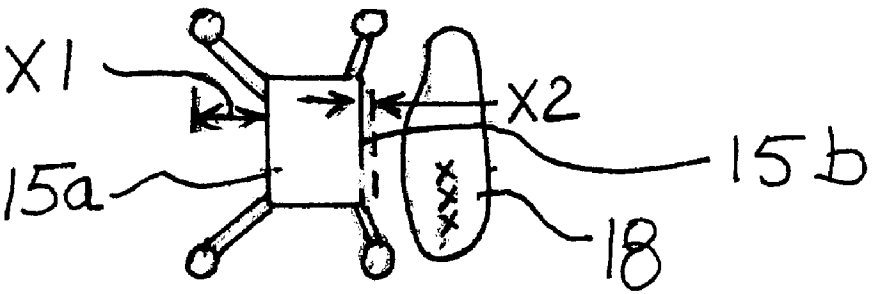
FIG. 1*a* is a plan view of a base plate and legs.

Four such legs are shown at 17*a*–17*d*, projecting from the four corners, respectively, of the plate 15, as seen in FIG. 1*a*. Forward and rearward legs 17*a* and 17*b* project laterally at dimension x from the plate edge 15*a*; and forward and rearward legs 17*c* and 17*d* project laterally at dimension $x_2$ from the opposite edge 15*b* of the plate. Dimension $x_2$ typically less than $x_1$, following the user's foot or shoe 18 to tread closer to the plate, whereby the cane shaft 10 and handle 11 may extend closer to the user's upper leg zone 20, for enhanced stability.

It is a feature of the invention that an articulated connection is provided between the shaft 10 and base 15 allowing the base to pivot relative to the upright shaft, depending upon the slope of the ground or floor surface 16, below the base. See in this regard the sidewardly sloping surface 16*a* in FIG. 2, and the frontwardly sloping surface 16*b* in FIG. 3. The base 15 can tilt or articulate sidewardly, as in FIG. 2, allowing legs 17*a*–17*d* to engage the, sloping surface, without tilting the shaft. See legs 17*a*–17*b* displaced relatively downwardly, as at 17*a*, to engage the sloping surface 16*a*, and legs 17*c* and 17*d* displaced relatively upwardly, as at 17*c*, to engage the laterally sloping surface. The base can also tilt or articulate forwardly and/or rearwardly, as seen in FIG. 3, allowing all legs to engage the sloping surface 16*b*. See rear legs 17*b* and 17*d* displaced relatively downwardly, as at 17*b*, to engage the sloping surface 16*b*, and front legs 17*a* and 17*c* displaced relatively upwardly, as at 17*a*, to engage the sloping surface 16*b*, the cane shaft 15 remaining upright.

A further feature as provided by the articulating connection is characterized in that articulation capability decreases as downward loading on the shaft is increased, and articulation capability increases as downward loading on the shaft is decreased.

In this regard, the connection, generally designated at 21 in the FIG. 1*b* schematic, includes a pivot 22 operatively connected to the base 15, as at 23, and a gripper 24 operatively connected to the shaft 10. The connection 21 is characterized in that articulation capability decreases as downward loading on the shaft is increased, and articulation capability increases as downward loading on the shaft is decreased. Further, the gripper is characterized by capability to increasingly grip the pivot 22 in response to increasing downward loading on the cane shaft, for example as exerted by the user. Such increasing gripping tends to stabilize the cane, to more safely support the user, once the base legs have engaged the sloping on uneven floor.

Figure 4:
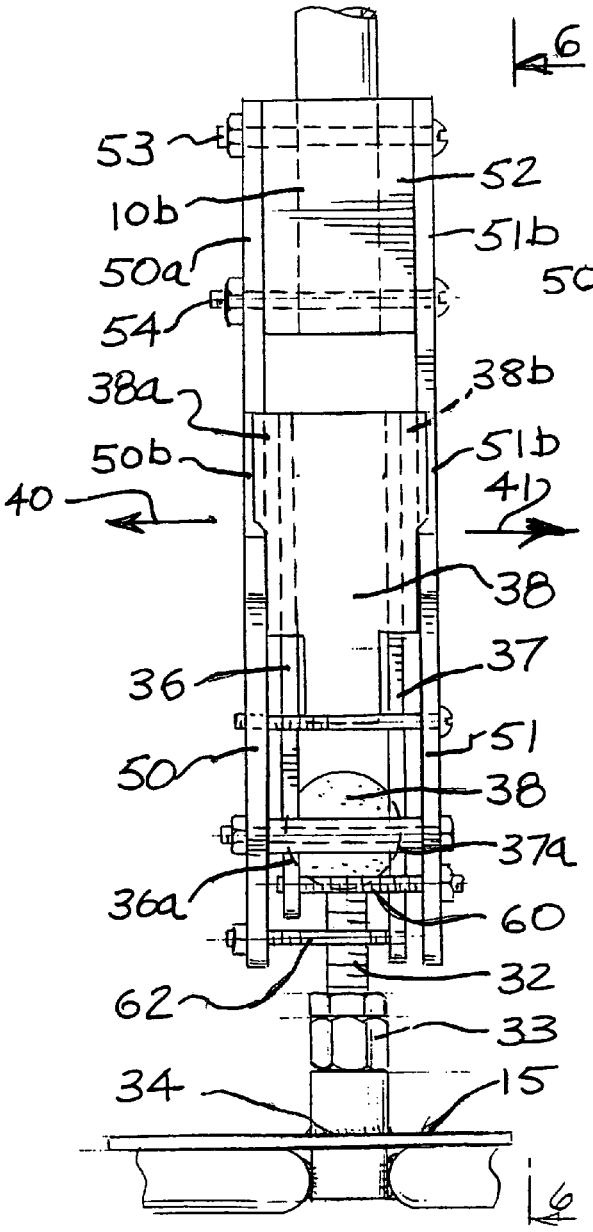
FIG. 4 is an enlarged frontal elevation of the lower portion of the FIGS. 1–3 cane, in unlocked condition.
Figure 5:
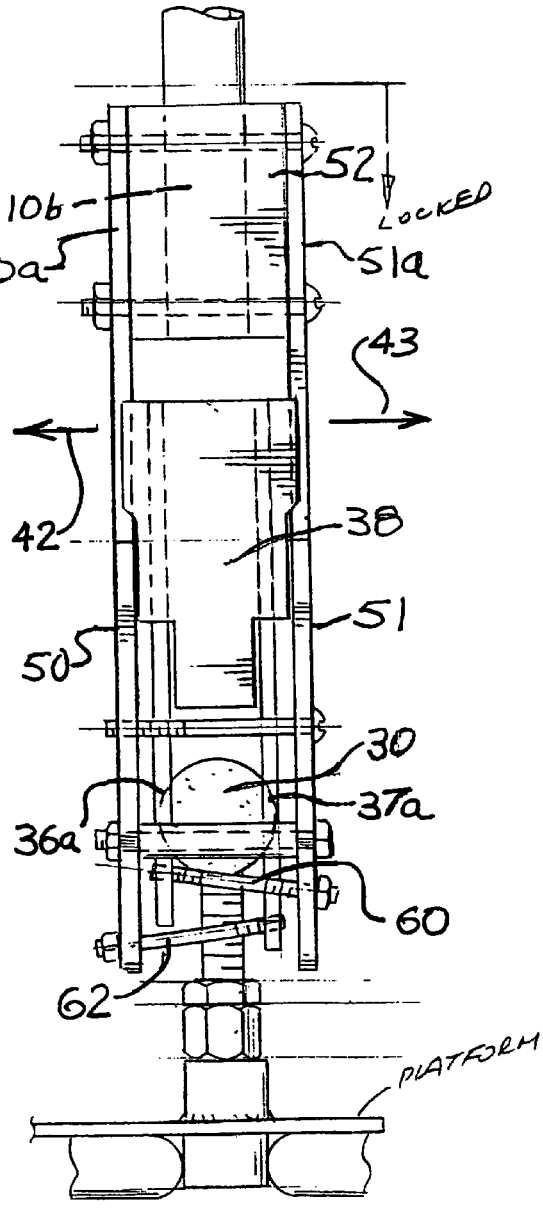
FIG. 5 is a view like FIG. 4 but showing the cane in a condition of friction limited articulation, or locked.

In the preferred form of the invention seen in FIGS. 4 and 5, the pivot comprises a ball 30 shown projecting upwardly from base 15, as via supporting elements 32 and 33. Element 32 comprises a threaded upper member that has adjustable screw threaded attachment to upright lower element 33 rigidly carried by the base, at 34. Ball 30 is mounted on 32, to be variably gripped. In the preferred embodiment the pivot joint can guide operator motion without limiting operator range of motion.

The preferred embodiment has a pivot with two approximately conic friction surfaces engaging a ball. The size and shape of the friction surfaces will determine the tracking in the pivot. "Tracking" in a pivot can be expressed by the variation of resistance to motion about various axes. The tracking ratio can be defined as the ratio of maximum to minimum resistance. A stiff hinge pivot has a very large ratio (theoretically infinite), a symmetrical ball socket joint has a tracking ratio of one. By increasing the vertex angle of the conic friction surfaces and reducing their effective diameter, the tracking ratio of the ball joint is increased. Tracking ratios of between one and ten are suitable in many therapeutic situations. In practice, the friction surfaces may be annular and conform to the ball surface, over a ring-like area.

In a versatile embodiment, the pivot can incorporate both: a pair of large diameter grippers that provide a low tracking ratio, and a pair of small diameter grippers with a large ratio. By varying the proportion of force in the two pairs of grippers a wide range of programmable tracking ratios can be attained in a single pivot mechanism. In a more complex embodiment multiple grippers with different tracking directions can be employed.

The gripper typically includes first and second parts, the first parts engaging the ball at laterally opposite sides thereof, and the second parts located to exert lateral force on the first parts tending to displace them laterally toward one another in response to increasing downward loading on the second parts.

In FIGS. 4 and 5, the gripper first parts are shown in the form of two inner plates 36 and 37 extending downwardly from a carrier block 38. Those plates extend at laterally opposite sides of the ball 30. The plates have shallow concave surfaces 36*a* and 37*a* that engage local zones of the ball at its laterally opposite sides, to create friction tending to resist pivoting movement of the plates in lateral directions 40 and 41 (see FIG. 4) and in transverse directions 42 and 43 (see FIG. 6). The ball and plate interengagement surfaces, or some of them, may be textured, for example roughened, to increase friction resisting pivoting. Plates 36 and 37 are in effect mounted on the ball, to resist their downward displacement relative to the ball. Block 38 in effect holds plates 36 and 37 adjacent the ball, thereby positioning them to form a ball pivoting socket.

In FIGS. 4 and 5 the gripper second parts are shown in the form of two outer plates 50 and 51 extending downwardly from a connection to the shaft 10 lower portion 10*b*. Plates 50 and 51 are interconnected, as at 112 in FIG. 8. See for example block 52 integral with the shaft lower portion, and located between laterally spaced upper extents 50*a* and 51*a* of the two plates 50 and 51. Fasteners 53 and 54 attach the plate upper extents 50*a* and 51*a* to the block 52. Medial extents 50*b* and 51*b* of the two plates extend at opposite sides of carrier block 38. That block has vertical grooves 38*a* and 38*b* that receives the plate medial extents 50*b* and 51*b*, thereby positioning block 38, while allowing vertical movement of plates 50 and 51 relative to the block 38 and the ball 30.

Figure 6:
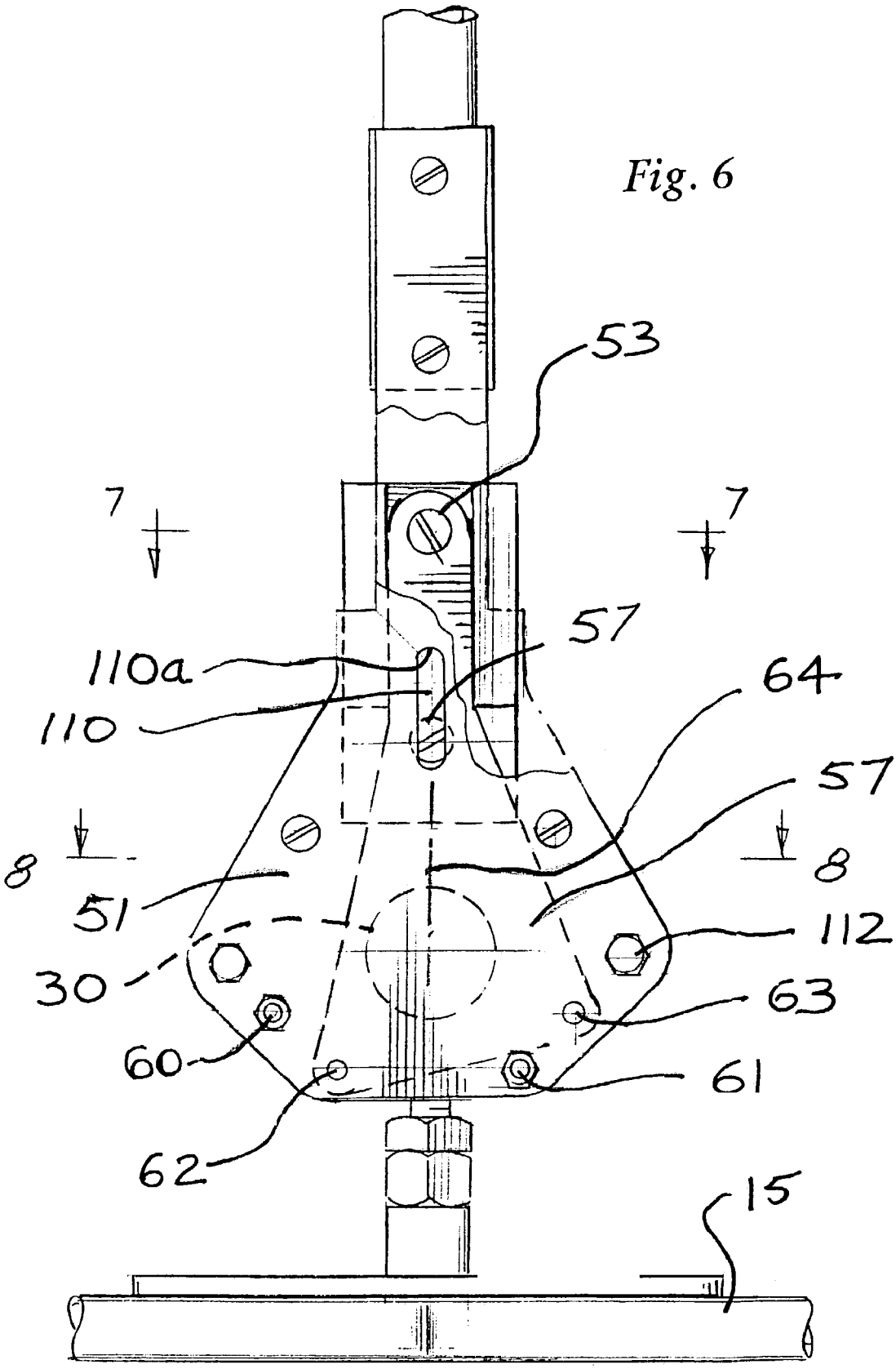
FIG. 6 is a side elevation taken on lines 6—6 of FIG. 4.
Figure 7:
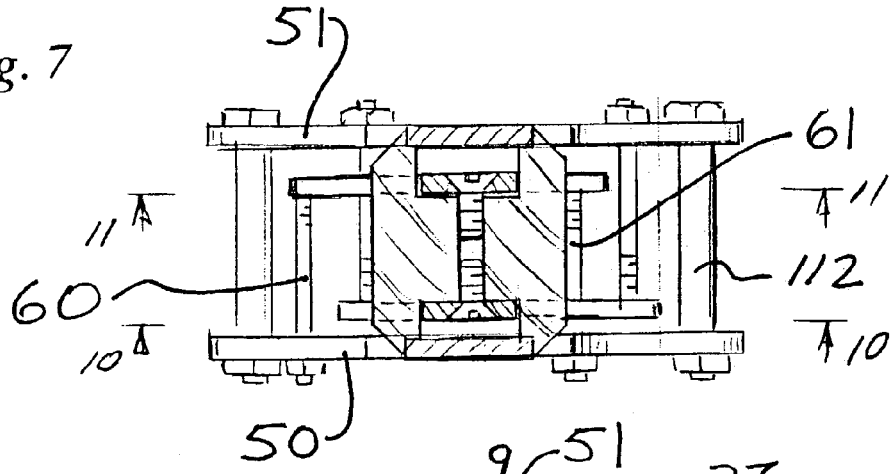
FIG. 7 is a horizontal section taken on lines 7—7 of FIG. 6.
Figure 8:
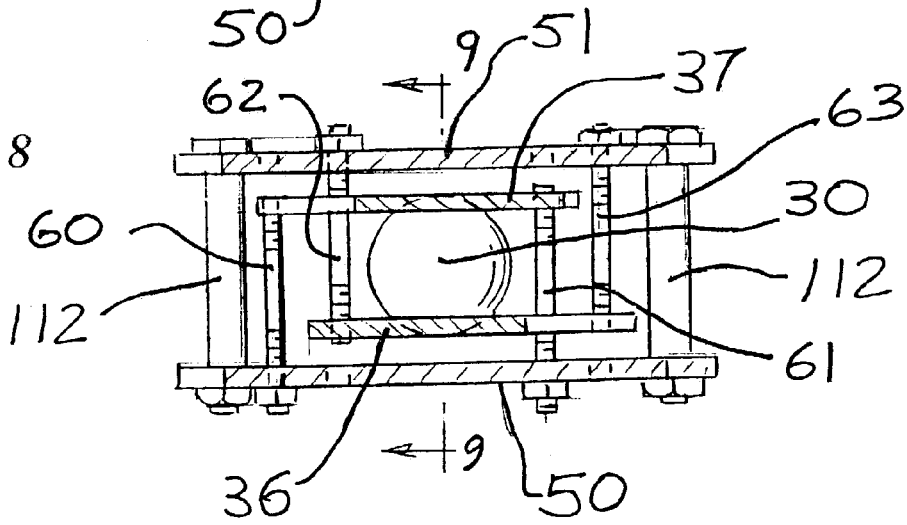
FIG. 8 is a section taken on lines 8—8 of FIG. 6.
Figure 9:
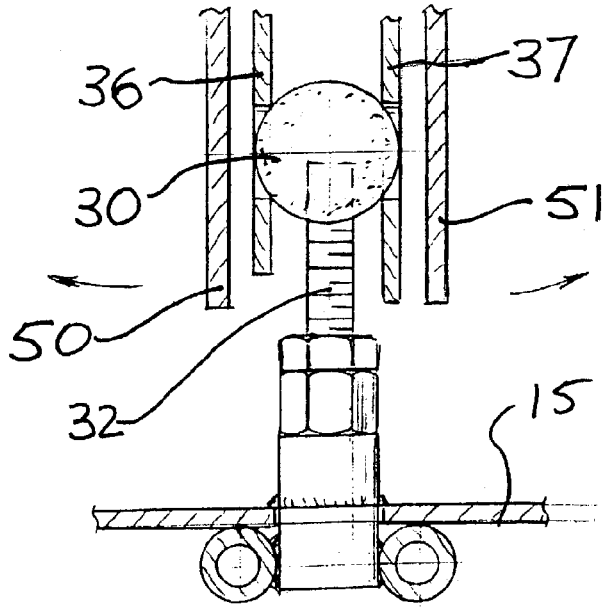
FIG. 9 is a vertical section taken on lines 9—9 of FIG. 8.
Figure 11:
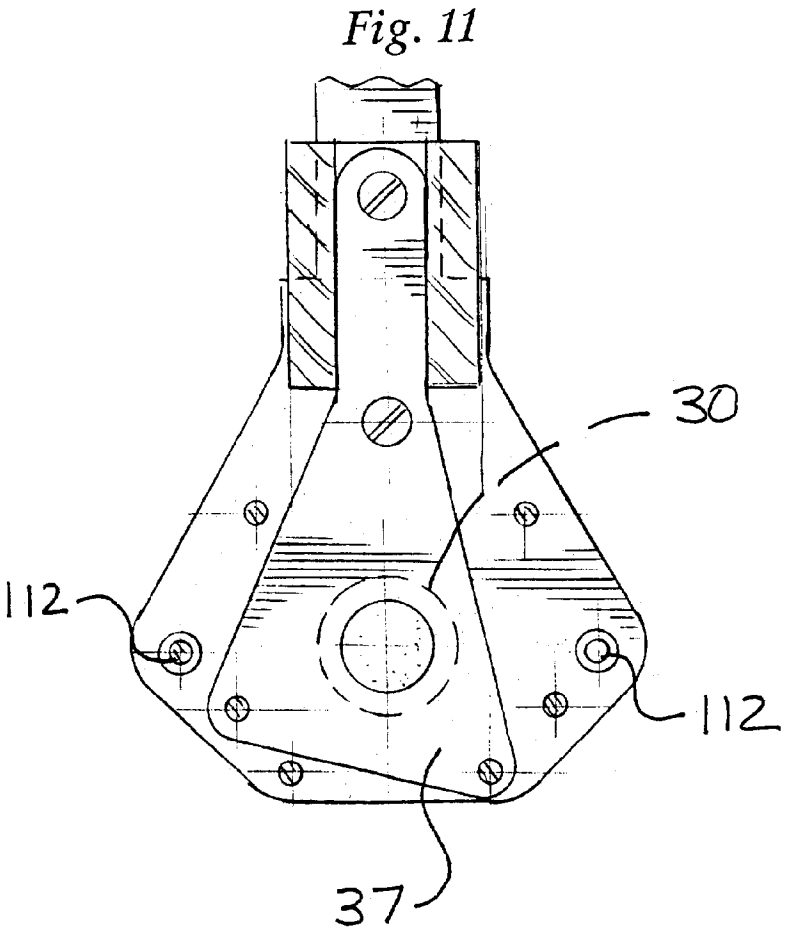
FIG. 11 is a vertical section taken on lines 11—11 of FIG. 7.
Figure 10:
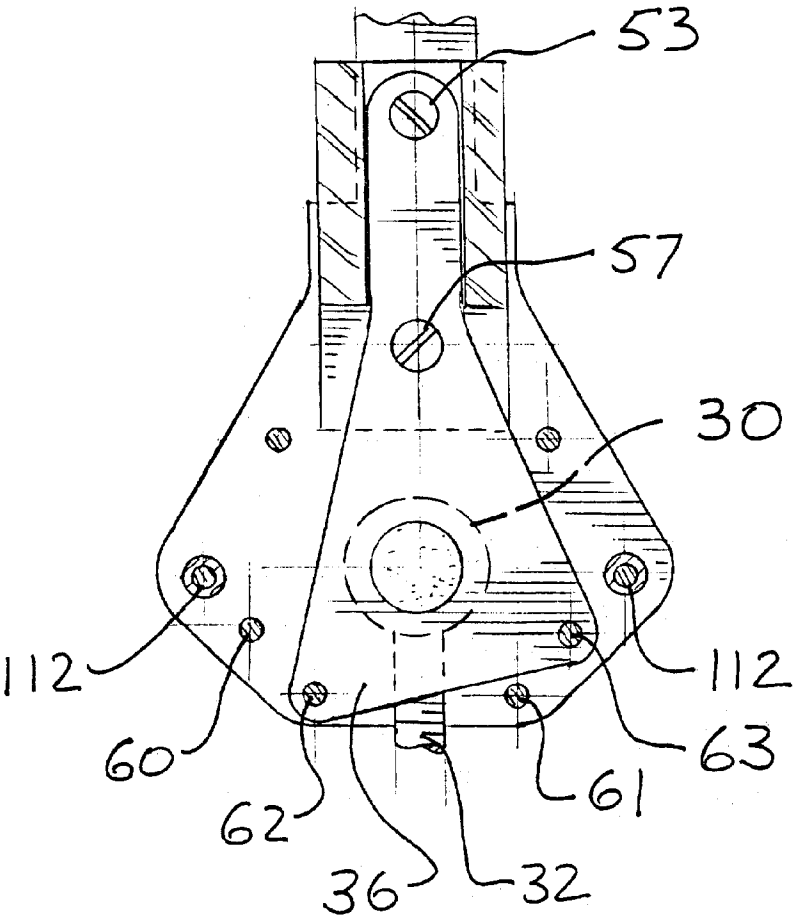
FIG. 10 is a vertical section taken on lines 10—10 of FIG. 7.

Also provided are tension members interconnecting the first and second parts to transmit increasing lateral force components to the first parts as the second parts are displaced downwardly relative to the first parts, for reducing shaft articulation capability. See for example the links (rods) 60–63 extending in generally lateral directions, and organized as follows:

links 60 and 61 interconnect inner and outer plates 36 and 51 and are located at opposite sides of a vertical plane 64 bisecting the ball, as seen in FIG. 6, and extending normal to the plates 50 and 51;

links 62 and 63 interconnect inner and outer plates 37 and 50, and are located at opposite sides of plane 64.

Note that the tension members or links are located below the level of the ball center; and they are configured relative to the plate so as to deflect by pivoting at their ends, or "cock" (see in FIG. 5) in response to downward movement of the outer plates, causing the inner plates 36 and 37 to be pulled toward one another to increasingly clamp the ball at the formed "split" socket. Also, as downward force on the shaft 10 is relieved, the tension members or links 60–63 tend to straighten out toward FIG. 4 configurations, relieving the clamping force on the ball, and thereby allowing universal swiveling of the cane shaft 10, in the manner of a joystick, which in turn allows the base to pivot relative to the ball center, and accommodate to unevenness of another floor or surface zone on which it is next placed by the cane user. In these ways the cane elements have multiple functions best suited to cane ease of use and safety. Note in FIG. 6 that a stop is provided at the top 110*a* of groove 110 in plate 51, to engage fastener 54, limiting downward travel of the plates 50 and 51 relative to plates 36 and 37.

The gripper mechanism's leverage can be set so that the locking action is firm, allowing the cane to be rocked up on one leg of the base while under load, or set looser, as needed. In addition to this main gripping action, the ball pivot can be provided with an adjustable low friction damper and/or spring centering mechanism as at 23 in FIG. 1*b*, that prevents the base from flopping around when the pivot is "unlocked" and the cane base is in the air. Both functions may be advantageously combined into a single molded pivot, which may have multiple adjustment points. The resistance to articulation produced by the gripping action is generally proportional to the diameter of the ball, all other factors being held constant.

The pivot joint can be provided with a key and keyway so that the base may rotate about the lateral axis and the longitudinal axis, but not about the vertical cane axis. In other words, the relative yaw motion of the two elements is constrained while relative pitch and roll have freedom of motion.

In an alternative embodiment, as shown in FIG. 3, the locking/unlocking action can be controlled by a finger trigger 25 or other operator interface (including: voice, detected by a microphone 26, electrode, pressure sensor, or other sensor 27.).

Figure 18:
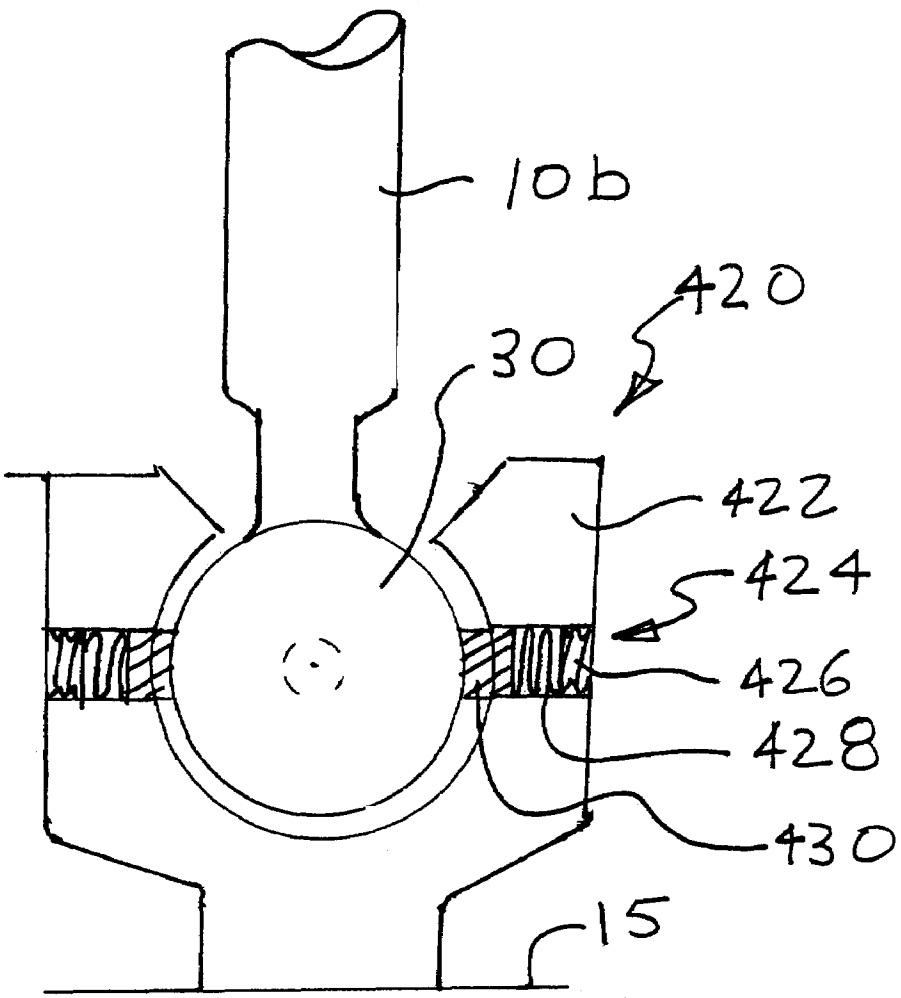
FIG. 18 is a schematic section view of yet another embodiment.

In another alternative embodiment, shown in FIG. 18, the pivot joint can be a simpler mechanism such as a constant friction ball joint 420, spring centering device, or a universal joint. As shown in FIG. 18, in the ball joint 420, the ball 30 is rigidly attached to the cane shaft 10*b*. The ball 30 is positioned within a cup 422. A friction adjuster 424 is provided on each of the four sides of the cup 422. Each friction adjuster includes a friction element 430, a spring 428 and a set screw 426. This provides for a constant, yet adjustable, friction joint.

Figures 19, 20:
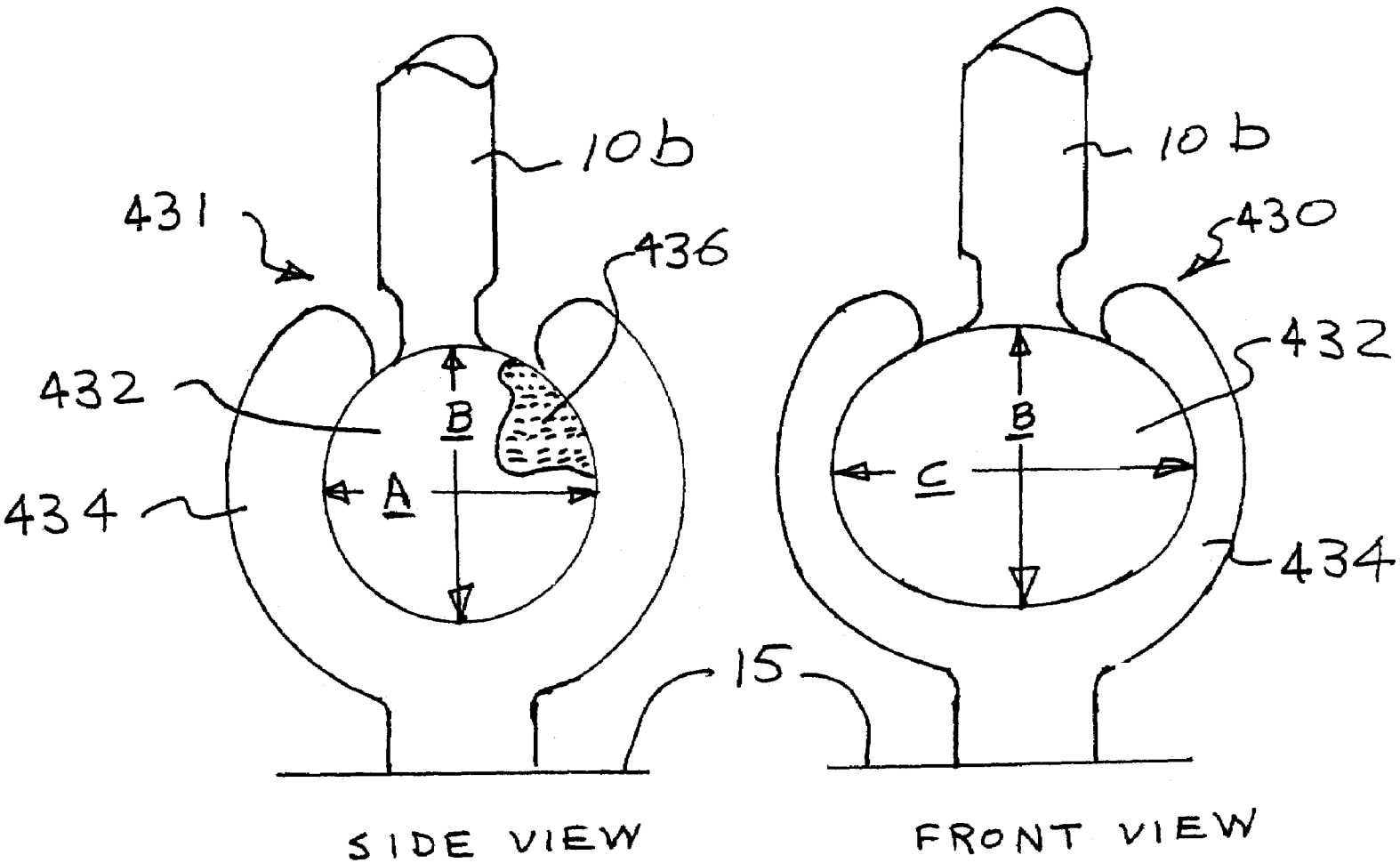
FIG. 19 is a schematic side section view of still another embodiment.
FIG. 20 is a schematic front section view of the design shown in FIG. 19.

In another embodiment, as shown in FIGS. 19 and 20, an individual nonspherical ball 432 and its receiver 434 gives the articulation and individually customized feel as desired by different users. In FIGS. 19 and 20, the ball is round in one plane (as viewed from the side) and non-round, e.g., oval, elliptical, etc. in a second plane (as viewed from the front).

The pivot arrangement can provide a path of least resistance to guide correct motion. A textured surface 436 on parts or all of the ball 432 and/or receiver 434 can provide another form of user tactile feedback guiding proscribed operator movement.

Figure 12:
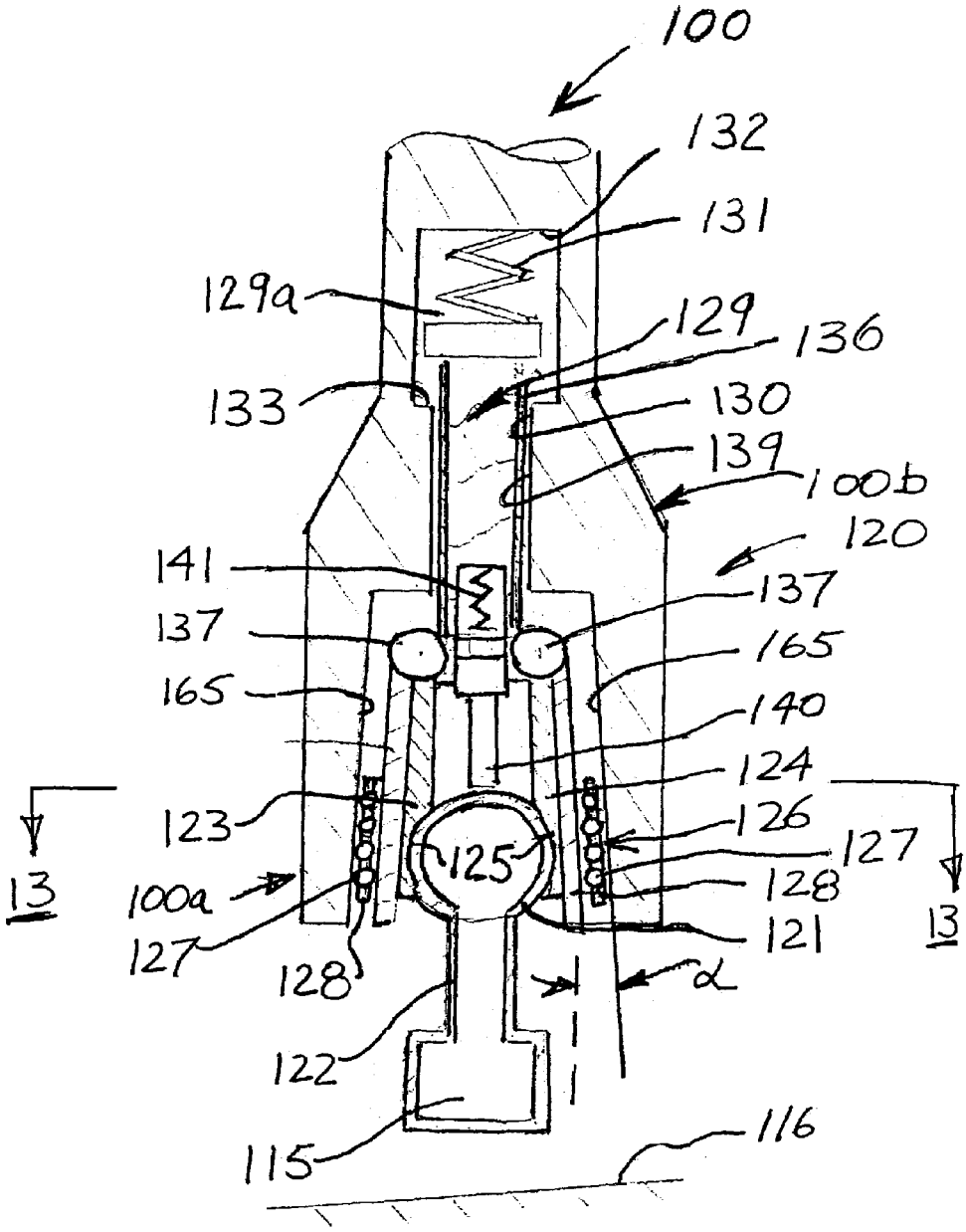
FIG. 12 is a section view of an alternative embodiment.

FIG. 12 shows in schematic form the following:

a. an upright shaft 100, a base 115, and an articulated connection in the form of assembly 120, allowing the base to pivot relative to the shaft, depending upon the slope of the surface 116 below the base, b. the connection or assembly 120 characterized in that articulation capability decreases as downward loading; on the shaft is increased, and articulation capability increases as downward loading on the shaft is decreased.

As shown, the connection 120 includes a pivot, including ball 121, operatively connected at 122 to the base 115, and gripper in the form of jaws 123 and 124 operatively connected to the shaft 100, and having concave surfaces 125 for increasingly gripping opposite sides of the ball in response to increasing downward (manual) loading on the shaft. In this example, lower sleeve extent or extents 100*a* of the handle is or are divergently downwardly tapered at surfaces 165; and anti-friction means or bearing 126 is provided between the surfaces 125 and the jaws, so that gripping forces are transmitted by means 126 to the jaws, tending to displace them toward the ball, as handle lower extensions 100*a* are displaced downwardly. Means 126 may take the form of rollers 127, caged at 128, and engaging surfaces 165 as well as linear races 228 on the jaws. The taper indicated angle a defined by each surface 125 is preferably less that 15°.

Upper extents of jaws 123 and 124 are carried by a vertically floating slider or carrier 129 extending within a bore 130 in the lower sleeve extent 100*b* of the handle; and a compression spring 131 fits between the top 129*a* of 129 and a shoulder 132 in the handle, to urge the slider and jaws downwardly relative to 100, 100*a* and 100*b*, for unlocking (positively disengaging) the assembly from ball clamping, when the handle is elevated. A stop shoulder 133 limits downward relative movement of 129. Friction damping or guiding of such movement may be provided as by a sleeve 136 on 129 and slidably engaging bore 139. Stiff pivot springs 137 carried by 129 yieldably and pivotably urge the jaws toward and adjacent the ball. A friction damper 140 presses downwardly on the top of the ball, to frictionally resist flopping of the ball and base, when the handle is not pushed down to effect ball gripping. A compression spring 141 yieldably urges damper 140 downwardly to forcibly engage the top of the ball.

Figure 13:
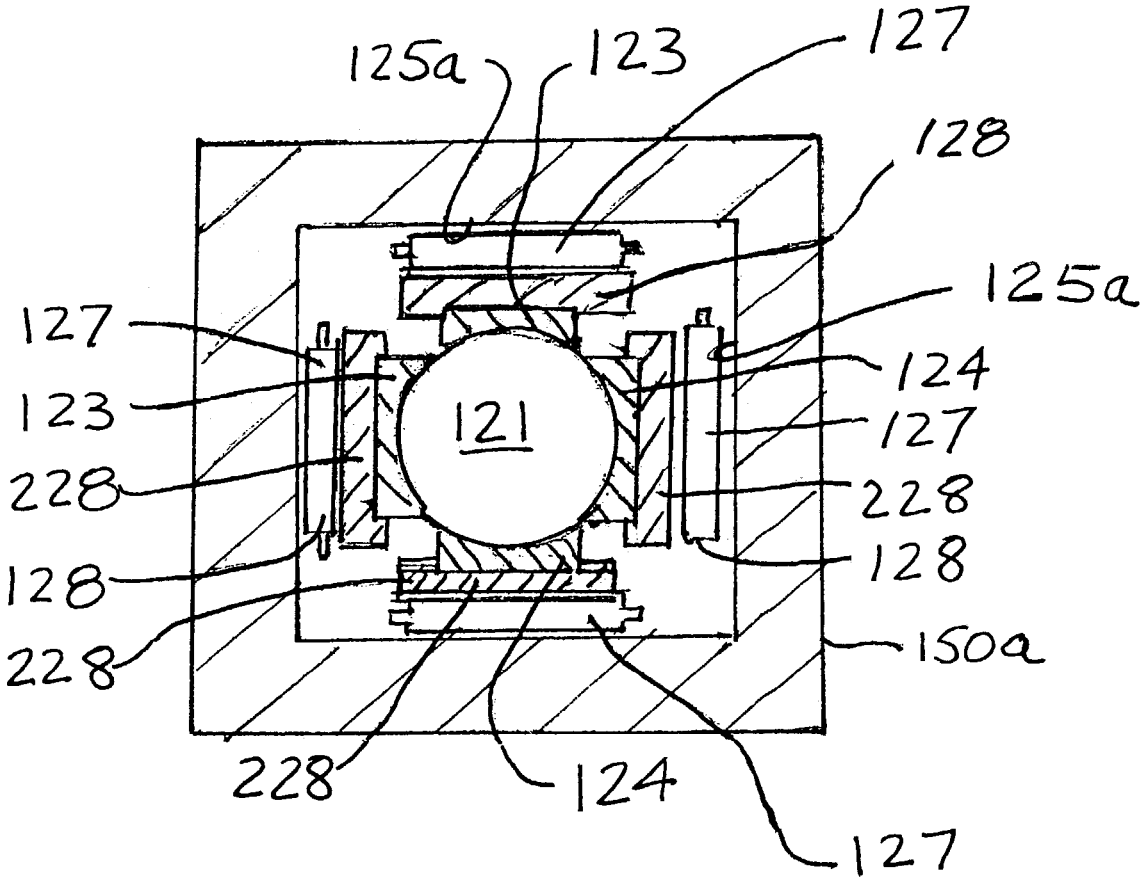
FIG. 13 is a section view taken along line 13—13 of FIG. 12.

FIG. 13 is a section showing elements of FIG. 12, with four jaws 123, 124, 123*a* and 124*a*, located at four quadrant positions about the ball vertical axis 121*a*. Four sets of caged rollers 127 are provided, in association with the respective four jaws, and four cages 128 are also provided. Four tapered surfaces 125*a* are provided on the shaft lower extension 100*a*.

Figure 14:
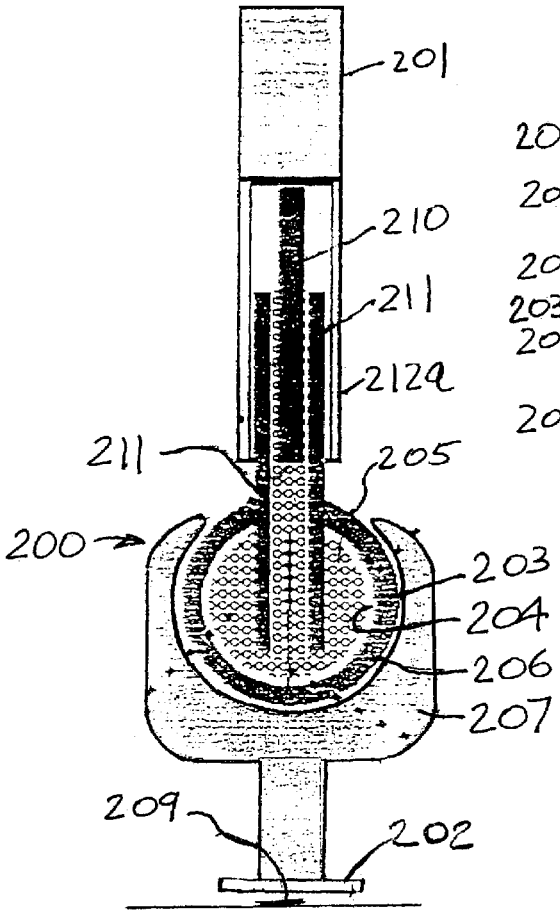
FIG. 14 is a schematic section view of an expansible ball embodiment.

FIG. 14 shows in schematic form a connection 200 between the shaft 201 and base 202, that connection incorporating an expansible ball 203. The ball typically has an interior hollow 204 to receive fluid such as liquid 205 that pushes outwardly in response to down loading of the shaft 201 to pressurably expand the ball. As the ball expands, its outer surface. 206 engages and grips the inner surfaces of a receptacle 207 attached to base 202. The base carries the legs engageable with the walking surface 209, as in FIGS. 1–3.

A piston 210 within a cylinder is pushed downwardly as the cane shaft 201 is lowered, resulting in pressure transmission to liquid 205 within the ball. Shaft lower cylindrical extension 212*a* guides on the cylinder 211 carried at 211*a* by the ball, to pivot therewith. Piston 210 and cylinder 211 define an actuator. Ball 203 receives the lower end of the cylinder 211, which carries the ball.

Figure 15:
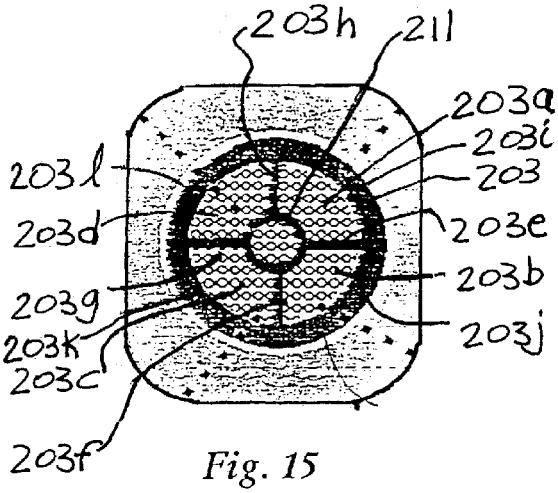
FIG. 15 is a schematic section view of a modification of the design shown in FIG. 14.
Figure 16:
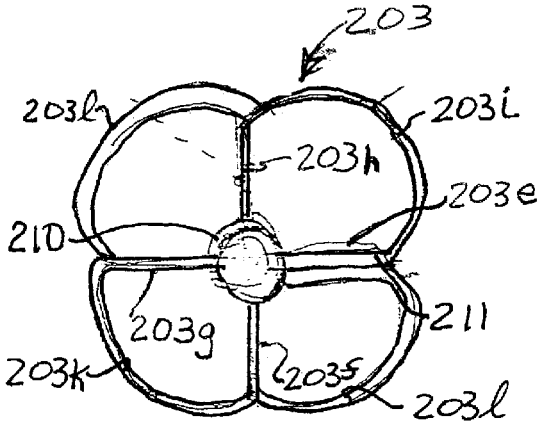
FIG. 16 is a detail view of FIG. 15.

FIGS. 15 and 16 show a modified FIG. 14 type ball 203 having interior sections 203*a*–203*d*, with webs 203*e*–203*h* between the sections. Outer arcuate ball walls 203*i*–203*l*, connected to the webs as shown, expand outwardly, individually, when ball liquid is pressurized.

Figure 17:
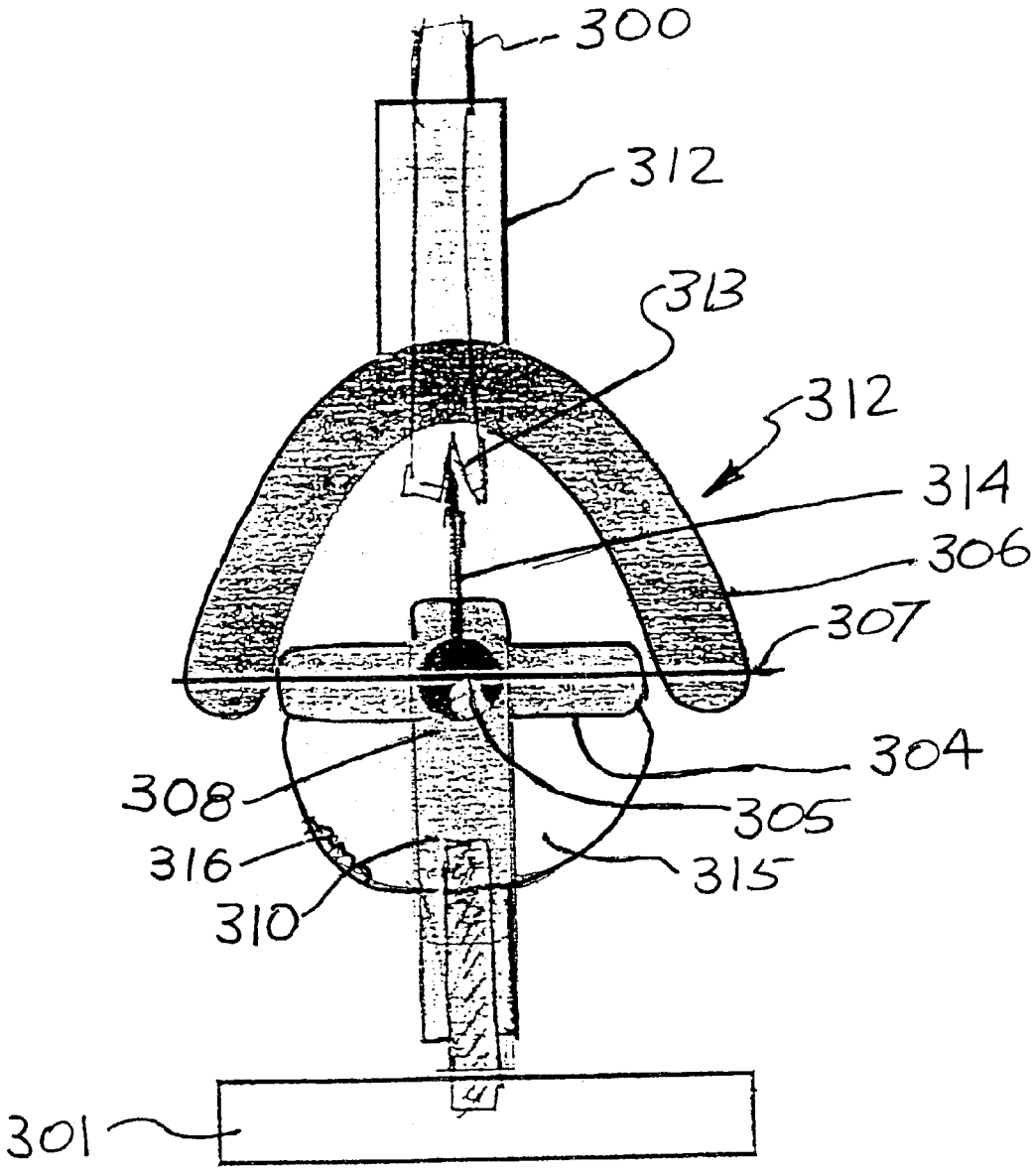
FIG. 17 is a schematic section view of another embodiment.

FIG. 17 shows a cane shaft 300, a base 301, and a two-axis universal joint type connection 302 between 300 and 301. Connection 302 includes a first pivoting member, at 304 defining a first axis 305 of pivoting normal to plane of FIG. 17, and a second pivoting member 306 defining a second axis 307 of pivoting, in the plane of FIG. 17. A type of gimbal is defined.

A bearing 308 for member 304 is defined by a post 310 extending upwardly from base 301. Member 306 supports a cylindrical guide 312 for shaft 300, so that the shaft pivots bi-directionally with 306, but is movable downwardly within 312, to frictionally slide at 313 adjacent an arcuate section or sector 314 acting as a friction damper to resist pivoting of the shaft about axis 307. Another section or sector 315 carried by member 304 resists pivoting of the shaft about axis 305, there being a friction surface 316 on 310 that engages 315.

In alternative embodiments, the base platform can be replaced with a second handle or other means of attaching to the user's body. Also proscribed pathways of motion can be defined by other means such as light, sound, vibration, electrical stimulation, pressure etc.

Thus, novel designs have been shown and described. Various modifications and substitutions can of course be made, without departing from the spirit and scope of the invention. The invention, therefore, should not be limited, except by the following claims, and their equivalents.

We claim:

1. A cane to assist walking, comprising:

a shaft, a base and an articulated connection allowing the base to pivot relative to the shaft, with the articulated connection including a pivot connected to one of the shaft and base and a gripper connected to the other of shaft and base, for increasingly gripping the pivot in response to increasing downward loading on the shaft; and with the articulation capability of the connection decreasing as downward loading on the shaft is increased, and articulation capability increasing as downward loading on the shaft is decreased.

2. The cane of claim 1 wherein the pivot comprises a ball.

3. The cane of claim 2 wherein the gripper comprises a socket in which the ball is received.

4. The cane of claim 3 wherein at least one of the ball and socket have a textured surface.

5. The cane of claim 2 wherein the gripper includes first and second parts, the first parts engaging the sides of the ball, and the second parts exerting force on the first parts tending to clamp the ball between them in response to increasing downward loading on the second parts.

6. The cane of claim 5 wherein the first parts define a socket in which the ball is received.

7. The cane of claim 5 including tension members interconnecting the first and second parts to transmit increasing lateral force components to the first parts as the second parts are displaced downwardly relative to the first parts, for reducing shaft articulation capability.

8. The cane of claim 7 wherein said tension members extend in generally lateral directions, and are supported to deflect or lock in response to downward movement of the second parts, to exert clamping force to the first parts.

9. The cane of claim 8 wherein said tension members are located below the level of a center defined by the ball.

10. The cane of claim 5 wherein the base comprises a platform having at least two protrusions.

11. The cane of claim 10 wherein said protrusions are outside a zone within which downward projections from said parts extend.

12. The cane of claim 1 including means restraining free pivoting of the base, relative to the shaft, when the base is lifted from the surface.

13. The cane of claim 1 wherein said connection defines a two-axis universal joint.

14. The cane of claim 13 wherein said universal joint includes a first pivoting member defining a first axis of pivoting, and a second pivoting member defining a second axis of pivoting, said members being interconnected.

15. The cane of claim 14 including a primary friction damper acting to damp shaft rotation about one of said axes, and a secondary friction damper acting to damp shaft rotation about the other of said axes.

16. A cane to assist walking, comprising:

a. a shaft, a base and an articulated connection allowing the base to pivot relative to the shaft; with the articulated connection including:

i. jaw means to controllably and grippingly engage the pivot, ii. said shaft having a lower extension, and mechanism associated with said lower extension and jaw means to urge the jaw means toward the pivot as the extension is urged downwardly, iii. a carrier for said jaw means located for movement relative to said extension, as the shaft is lowered and elevated; and b. with the articulation capability of the connection decreasing as downward loading on the shaft is increased, and articulation capability increasing as downward loading on the shaft is decreased.

17. The cane of claim 16 including spring means acting to urge the jaw means toward the pivot, and a friction damper carried by said carrier to engage the pivot and resist relative pivoting between the pivot and shaft.

18. The cane of claim 16 wherein said jaw means includes four jaws spaced about the pivot, in the form of a ball, said mechanism including four anti-friction devices to transmit force to said respective four jaws.

19. A cane to assist walking, comprising:

a. a shaft, a base and an articulated connection including an expansible ball allowing the base to pivot relative to the shaft;

b. with the articulation capability of the connection decreasing as downward loading on the shaft is increased, and articulation capability increasing as downward loading on the shaft is decreased.

20. The cane of claim 19 wherein the connection includes fluid within the ball, and an actuator connected to the shaft to increase fluid pressure within the ball in response to down loading of the shaft.

21. The cane of claim 20 wherein the connection includes a receptacle about the ball to grip the ball as it expands, the receptacle connected to the base.

22. The cane of claim 21 wherein the actuator includes a cylinder that pivots with the ball, and a piston movable in the cylinder to pressurize the fluid.

23. The cane of claim 20 wherein the ball has interior webs between the sections, and outer arcuate walls connected to the webs, for expanding outwardly, individually, when ball liquid or fluid is pressurized.

24. A cane to assist walking, comprising:

a. a shaft, a base and an articulated connection allowing the base to pivot relative to the shaft;

b. with the articulation capability of the connection decreasing as downward loading on the shaft is increased, and with the articulation capability increasing as downward loading on the shaft is decreased, and with the articulation capability substantially independent of the orientation of the shaft to the base.

25. A cane to assist walking, comprising:

a. a shaft, a base and an articulated connection allowing the base to pivot relative to the shaft;

b. with the articulation capability of the connection decreasing as downward loading on the shaft is increased, and articulation capability increasing as downward loading on the shaft is decreased, and wherein the articulation connection provides resistance to movement of the shaft relative to the base via friction between two or more surfaces.

26. A cane to assist walking, comprising:

a. a shaft, a base and an articulated connection allowing the base to pivot relative to the shaft;

b. with the articulation capability of the connection decreasing as downward loading on the shaft is increased, and articulation capability increasing as downward loading on the shaft is decreased, with the articulation connection adjustable to provide more or less resistance to articulation movement between the shaft and the base, based on characteristics of an intended user of the cane.

* * * * *